United States Patent [19]

Pohl et al.

[11] Patent Number: 4,756,219

[45] Date of Patent: Jul. 12, 1988

[54] CROSS-CUTTER

[75] Inventors: Walter Pohl; Arthur Dirks, both of Hamburg, Fed. Rep. of Germany

[73] Assignee: Peters Maschinenfabrik GmbH, Fed. Rep. of Germany

[21] Appl. No.: 105,408

[22] Filed: Oct. 5, 1987

[30] Foreign Application Priority Data

Oct. 8, 1986 [DE] Fed. Rep. of Germany ..... 3634198

[51] Int. Cl.[4] ..... B26D 1/62

[52] U.S. Cl. ..... 83/344; 83/342; 83/345

[58] Field of Search ..... 83/345, 346, 344, 343, 83/342, 341

[56] References Cited

U.S. PATENT DOCUMENTS 3,570,348 3/1971 Hallden ..... 83/342
3,709,077 1/1973 Trogan et al. ..... 83/342 X
3,828,636 8/1974 Smith ..... 83/341
4,061,063 12/1977 Brush ..... 83/345 X
4,656,905 4/1987 Ginzburg et al. ..... 83/341 X

FOREIGN PATENT DOCUMENTS 1808981 7/1970 Fed. Rep. of Germany .
2722872 11/1978 Fed. Rep. of Germany ..... 83/344

*Primary Examiner*—Donald R. Schran
*Attorney, Agent, or Firm*—Harness, Dickey & Pierce

[57] ABSTRACT

Cross-cutter for cutting web material, in particular corrugated cardboard, comprising a pair of knife shafts which are tubularly supported for rotation on a core secured in the machine frame and commonly driven by a drive means, the knives temporarily contacting each other during the cutting operation under bias, if necessary, at least one end of at least one core having associated therewith a power unit which produces a flexural moment at the core such that the knives abut against each other under bias during the contact.

10 Claims, 1 Drawing Sheet

CROSS-CUTTER

BACKGROUND OF THE INVENTION

The invention relates to a cross-cutter for cutting web material, in particular corrugated cardboard, according to the preamble of claim 1.

Cross-cutters for corrugated cardboard production apparatus normally include pairs of knife shafts in which each shaft holds at least one knife with a continuously extending cutting edge which has a uniform distance from the shaft axis. The knife blade either extends in parallel to the shaft axis or is arranged helically. The helical arrangement has the advantage that during the cutting operation always only a short portion of the cutting edges are in engagement with each other at a single instant, whereby the loading on the knives, the knife retainer and the shafts is maintained low. The cutting edges of the knives describe circles which intersect slightly. The cutting edge of the one knife lies in the leading region of the knife blade and the other in the trailing region thereof. The radius of revolution of the cutting edge in the trailing region is selected to be slightly greater than the radius of the other cutting knife, so that only a single contact of the cutting edges occurs during one revolution, with the cutting edges moving apart relatively quickly after that contact.

The knife of at least one shaft is adjustably secured at a number of points. If a contact of the knife edges is no longer ensured due to wear, at least one knife requires adjustment. This job requires interruption of production and very much time. With tough material or from a certain grammage of the corrugated cardboard on or also with moist or coated corrugated cardboard, a not insignificant bias between the knives must be set to attain an unobjectionable cut. A greater bias involves high cutting forces. High cutting forces in turn necessitate adjustment of the knives at relatively short intervals, which causes undesired interruptions of production. High cutting forces also cause rapid wear of the knives. Since heavy materials to be cut do not occur very often, it would be more favourable in view of the service life of the knives to reduce the once adjusted high bias. Since, however, the usual adjustment of the knives is a time-consuming and complicated job, a relatively high knife bias is used in practice even in connection with light qualities. This means great knife wear and low knife service life, which are not so much due to the material than to the high bias.

Hence, the object of the invention is to provide a cross-cutter for cutting web material, in particular corrugated cardboard, in which the service life of the knives is prolonged.

SUMMARY OF THE INVENTION

Said object is solved by the features of the characterizing part of claim 1.

The shafts carrying the knives or knife bars span a considerable length. It is therefore known to tubularly support the knife bars on a stationary core. The solid core is fastened in the machine frame and increases the requisite bending strength for cutting without increasing the mass moment of inertia of the knife bar.

In the cross-cutter of the invention, flexural moment is applied to at least one end of a core by means of an adequate power unit which can be a mechanical, hydraulic, pneumatic or electromagnetic one. The direction of force is such that the deflection of the core and thus also of the knife shaft causes an increase in bias. The directions of deflexion of the core therefore is approximately parallel to the direction of adjustment of the knives. According to another aspect of the invention, the loading direction of the power unit is, however, variable to change the direction of deflection.

In the cross-cutter of the invention a power unit acts on possibly both ends of a core to attain a uniform deflection. There is naturally also the possibility of bending both cores of a pair of knife shafts. The force to be applied to a core to obtain a desired bias can thus be halved.

Through the invention, it is achieved that the knives on the knife shafts are adjustable by means of their adjusting screw such that the usual light board qualities are cut. This means particularly careful treatment of the knives and thus increased service life. If tough cardboard is to be cut with the cross-cutter, the knives would normally be set very hard. In the invention, the knife bar is prebend by the application of a bending moment onto the core such that a desired knife bias is attained. The degree of the bias can be made dependent on the quality of the material to be cut. Production need not be interrupted. A desired bias is removable as quickly as it is applicable, viz. by terminating the loading through the power unit.

Expediently the power unit is controlled by an adequate control device which in turn can also be programmed to provide for a corresponding bending stress on the core of the knife bars when different qualities are to be cut. The desired deflection, depending upon the application, need by only fractions of a millimenter in order to adjust a desired bias. Naturally the deflection will be greatest in the middle of the knife bar. This effect is not, however, disadvantageous; on the contrary, the cutting operation is particularly critical in this region, so that a relatively strong bias always ensures an unobjectionable cut.

BRIEF DESCRIPTION OF THE DRAWINGS

The invention will be described below in greater detail with reference to the accompanying drawings in which.

DETAILED DESCRIPTION OF THE PREFERRED EMBODIMENTS

Figure 1:
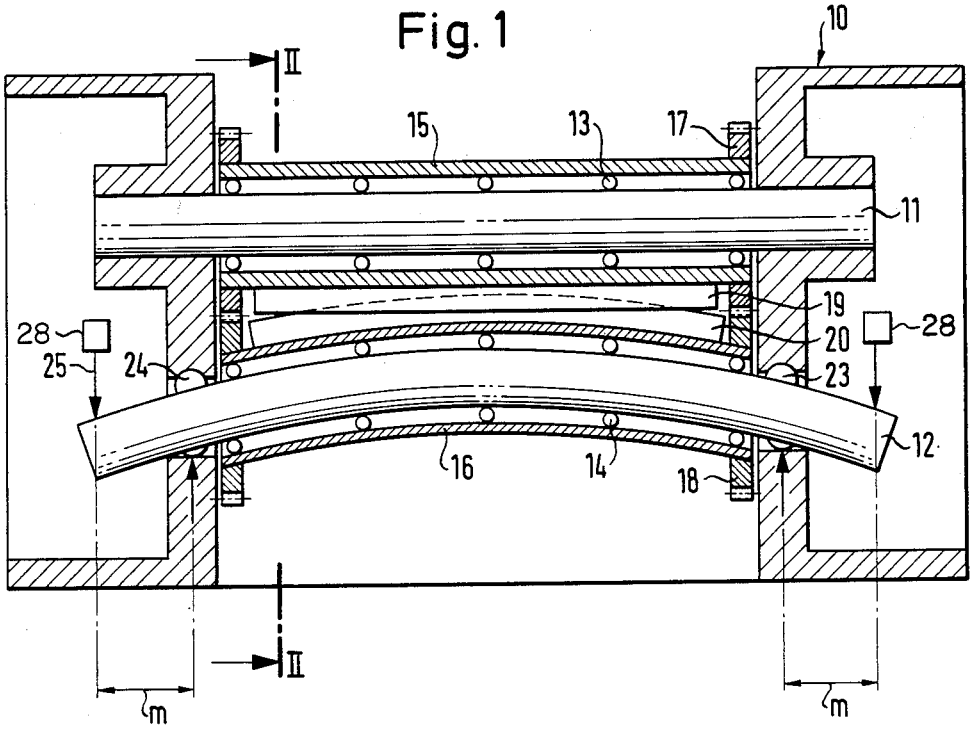
FIG. 1 is a very schematic side and partly sectional view of a cross-cutter of the invention.

Before setting forth the details shown in the drawings, it is premised that every feature described is of essential importance to the invention per se or in conjunction with features of the claims.

Figure 2:
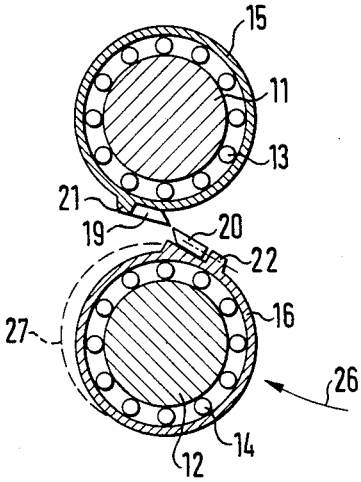
FIG. 2 is a section through the cross-cutter of FIG. 1 along the line 2—2.

A machine frame 10 of a cross-cutter has arranged therein two cores 11,12. They are supported via respective anti-friction bearings 13,14 in hollow shafts 15,16. The hollow shafts 15,16 carry at the ends respective gear wheels 17,18, so that the hollow shafts 15,16 are coupled for fixed rotation. The drive of the gear wheels 17,18 is not shown. Knives 19,20 are connected to the hollow shafts 15,16. For clearness' sake, they are illustrated as straight knives extending in parallel to the shaft axis. Normally cross-cutters have secured thereto knives with a helically extending cutting edge. As shown in FIG. 2, the knife 19 of the upper shaft 15 is fixedly secured to a retainer 21. The lower knife 20 is adjustable with respect to its retainer 22 to abut against the upper knife 21 under bias as the knife edges contact each other.

The lower core 12 is movably supported in the machine frame 10 via self-aligning bearings 23,24. Its ends protrude a certain extent at both sides. Via a power unit 28 a force can be exerted on both ends as indicated by the arrows 25. A flexural moment is thus applied at both sides to the core 12, the moment arm being denoted by m. The direction of the deflection is shown in FIG. 2 by arrow 26. The direction of deflection is approximately parallel to the direction of adjustment of the lower knife 20. The corresponding deflection is shown in FIG. 2 by the dashed line 27. In both FIG. 1 and FIG. 2 the deflection of the knife shaft 26 is exaggerated. It is apparent that owing to the deflection the knives 19, 20 abut each other under an increased bias as they contact each other. Said bias depends on the degree of deflection and the latter depends on the bending force applied. If flexural moment is applied to both cores 11,12, the bending force is halved.

The application of the flexural moment can be effected by any adequate power device which can be operated pneumatically, hydraulically, mechanically, electromechanically or the like.

We claim:

1. Cross-cutter for cutting web material such as corrugated cardboard, comprising a pair of knife shafts rotatably supported in telescoped fashion on respective cores secured in a machine frame and driven by a drive means, knives carried by said knife shafts temporarily contacting each other during the cutting operation under selected bias characterized in that at least one end of at least one core has associated therewith a power unit which produces a flexural moment at said one core for biasing said knives against each other during their contact.

2. Cross-cutter as in claim 1, wherein at least the knife of the one shaft is adjustably secured thereto, characterized in that the direction of deflection of the core by the power unit is substantially parallel to the direction of adjustment of said knife.

3. Cross-cutter as in claim 1, characterized in that the loading direction of the power unit is variable for changing the direction of deflection.

4. Cross-cutter as in claim 1, characterized in that the one core is supported in the machine frame via a self-aligning bearing.

5. Cross-cutter as in claim 2, characterized in that the loading direction of the power unit is variable for changing the direction of deflection.

6. Cross-cutter as in claim 2, characterized in that the one core is supported in the machine frame via a self-aligning bearing.

7. Cross-cutter as in claim 3, characterized in that the one core is supported in the machine frame via a self-aligning bearing.

8. Cross-cutter as in claim 5, characterized in that the one core is supported in the machine frame via a self-aligning bearing.

9. Cross-cutter as in claim 1, wherein there are a pair of power units each associated with a respective end of the one core for producing flexural movement of said one core.

10. Cross-cutter as in claim 2, wherein there are a pair of power units each associated with a respective end of the one core for producing flexural movement of said one core.

* * * * *